US011635272B1

(12) United States Patent
Cisnero

(10) Patent No.: US 11,635,272 B1
(45) Date of Patent: Apr. 25, 2023

(54) BIPOD STABILITY ASSEMBLY

(71) Applicant: Michael P. Cisnero, Kenner, LA (US)

(72) Inventor: Michael P. Cisnero, Kenner, LA (US)

( * ) Notice: Subject to any disclaimer, the term of this patent is extended or adjusted under 35 U.S.C. 154(b) by 0 days.

(21) Appl. No.: 17/681,821

(22) Filed: Feb. 27, 2022

(51) Int. Cl.
*F41A 23/02* (2006.01)
*F41A 23/10* (2006.01)

(52) U.S. Cl.
CPC ..... *F41A 23/02* (2013.01); *F41A 23/10* (2013.01)

(58) Field of Classification Search
CPC ..... F41A 23/02; F41A 23/10
See application file for complete search history.

(56) References Cited

U.S. PATENT DOCUMENTS 3,012,350 A * 12/1961 Wold ..... F41A 23/16 89/37.04
3,041,938 A * 7/1962 Seabrook ..... F41A 23/16 42/99
3,935,657 A * 2/1976 Wade ..... F41A 23/00 42/94
4,790,096 A * 12/1988 Gibson ..... F41A 23/16 42/94
4,821,443 A * 4/1989 Bianco ..... F41A 25/02 42/94
D312,650 S * 12/1990 Charrier ..... 396/419
5,233,779 A * 8/1993 Shaw ..... F41A 23/02 42/94
5,332,185 A * 7/1994 Walker, III ..... F41A 23/02 248/910
5,333,829 A * 8/1994 Bell ..... F16M 13/00 248/634
D384,498 S * 10/1997 Hughes ..... D3/221
5,875,580 A * 3/1999 Hill ..... F41A 23/02 42/94
5,937,559 A * 8/1999 Jennen ..... F41A 23/18 42/99
6,042,080 A 3/2000 Shepherd et al.
6,378,235 B1 * 4/2002 Smith ..... F41A 23/02 42/94
6,860,054 B1 * 3/2005 Mosher ..... F41A 27/24 42/94
7,665,241 B2 2/2010 Oz
7,866,081 B2 * 1/2011 Seuk ..... F41C 27/22 73/167
8,104,212 B2 * 1/2012 Potterfield ..... F41A 23/04 42/94
8,286,381 B2 * 10/2012 Seuk ..... F41C 23/14 42/74
8,516,733 B1 * 8/2013 Richey, Jr. ..... F41C 23/16 42/94
D701,584 S 3/2014 Kasbohm
8,739,453 B1 6/2014 Conner
9,360,273 B1 * 6/2016 Steinbock ..... F41A 23/18
9,528,794 B2 * 12/2016 Franklin ..... F41A 23/16
9,574,839 B2 2/2017 Genchel et al.
D783,110 S * 4/2017 Haas ..... D22/108
9,933,226 B2 * 4/2018 Tucker ..... F41C 33/003
9,964,254 B1 * 5/2018 Hayes ..... F41A 23/16
(Continued)

*Primary Examiner* — Michelle Clement
(74) *Attorney, Agent, or Firm* — Cramer Patent & Design, PLLC; Aaron R. Cramer

(57) ABSTRACT

A bipod stability assembly is a magnetic device having mating magnets on a rifle and a sandbag or bipod. A user my quickly interchange either by removing the first stability support and connecting the second.

20 Claims, 3 Drawing Sheets

(56) References Cited

U.S. PATENT DOCUMENTS 10,048,034 B1 * 8/2018 Reasor ..... F41A 23/16
10,323,898 B1 * 6/2019 Phillips ..... F41A 23/16
RE47,531 E * 7/2019 Steinbock ..... F41A 23/18
10,415,922 B2 9/2019 Reik
10,495,402 B2 * 12/2019 Morris ..... F41A 23/18
D873,944 S * 1/2020 Badgett ..... D22/199
10,670,365 B2 * 6/2020 Coleman ..... F41C 27/22
10,808,880 B1 * 10/2020 Gearing ..... F16M 11/14
D901,873 S * 11/2020 Hughes ..... D3/201
10,852,092 B1 * 12/2020 Lindsay ..... F41A 23/12
10,890,406 B1 * 1/2021 Whang ..... F41C 33/001
11,168,830 B2 * 11/2021 Bryant ..... H04N 5/2252
2002/0184709 A1 * 12/2002 Berry, IV ..... A47C 27/086 5/655.4
2008/0034636 A1 * 2/2008 Potterfield ..... F41A 23/04 42/94
2008/0263928 A1 * 10/2008 Potterfield ..... F41A 23/16 42/94
2009/0025267 A1 * 1/2009 Reinert ..... F41C 27/00 42/94
2009/0049731 A1 * 2/2009 Seuk ..... F41A 23/16 42/94
2009/0229160 A1 * 9/2009 Elliott ..... F41A 23/04 42/71.01
2011/0131861 A1 * 6/2011 Seuk ..... F41C 27/22 42/94
2012/0246991 A1 * 10/2012 Seuk ..... F41C 33/001 42/94
2012/0255212 A1 * 10/2012 Werner ..... F41A 31/02 42/90
2013/0081317 A1 * 4/2013 Mangum ..... F41C 27/22 42/94
2013/0298439 A1 * 11/2013 Mahnke, III ..... F41A 23/02 42/94
2014/0215889 A1 * 8/2014 Abdennour ..... F41C 27/00 42/94
2015/0013205 A1 * 1/2015 Franklin ..... F41A 23/02 42/94
2015/0292830 A1 * 10/2015 Tread ..... F41A 23/04 42/94
2016/0169607 A1 * 6/2016 Rahman ..... F41A 23/02 89/37.04
2016/0363407 A1 * 12/2016 Hanington ..... F41A 23/04
2017/0089659 A1 * 3/2017 Almond ..... F41C 23/16
2018/0289135 A1 * 10/2018 Bezem ..... F41C 33/005
2019/0285376 A1 * 9/2019 Bales ..... F41A 23/16
2020/0049444 A1 * 2/2020 Cerda ..... B60R 7/14
2021/0063108 A1 * 3/2021 Parsons ..... B60R 7/14
2021/0278161 A1 * 9/2021 Gearing ..... F41A 23/08
2022/0196359 A1 * 6/2022 Gearing ..... F41A 23/02
2022/0290801 A1 * 9/2022 Gearing ..... F16M 11/14

* cited by examiner

BIPOD STABILITY ASSEMBLY

RELATED APPLICATIONS

Non-applicable.

FIELD OF THE INVENTION

The presently disclosed subject matter is directed to a bipod stability assembly.

BACKGROUND OF THE INVENTION

Over the years, modern advances in hunting/shooting equipment have enhanced the sport, providing users with increased success. One such product is the rifle bipod. Such bipods consist of two legs positioned in a triangular shaped arrangement with a rifle rest on top. They provide rigid, steady support with unequaled versatility and portability, thus increasing the hunter's chance of success when taking that all important shot. However, other shooters prefer a bean bag to support a rifle.

Beanbags are great for uneven surfaces and allow for minute adjustments just not possible with a bipod support. However, when a shooter wishes to use a bean bag, the bipod mount must typically be removed. Accordingly, there exists a need for a means by which a rifle can be supported by a bean bag or a bipod mount in an easy manner depending on the sooters needs. The development of the dual stabilization device for rifles fulfills this need.

SUMMARY OF THE INVENTION

The present invention provides for a dual stabilization device that has, a rifle utilized where accuracy of a shot produced by the rifle is important, a mounting hub having a pair of legs, a magnetic disc supported by a pendant at a first point, while a second point of the pendant is connected to an underside of the mounting hub, a mounting means attached to a top of the mounting hub is attached to the rifle to the mounting hub, a support bag attached to the magnetic disc, the support bag includes an outer surface, a plurality of seams, and a bottom surface, and a folding means folding up the pair of legs. The pair of legs are folding and adjustable length legs. The pair of legs are for a bipod support system to increase accuracy of aim, ease of shooting and comfort of use thus generating one or more accurate shots. The first point of the pendant is lower than the second point of the pendant.

The support bag may be used to increase accuracy of aim, ease of shooting and comfort of use thus generating the one or more accurate shots. The pair of legs may include a leg cap. Each of the pair of legs may include a length adjusting means. The magnetic disc may be attached to an underside of the mounting hub via the pendant to form a fixed and non-movable assembly. The magnetic disc may hold the support bag in place once attracted, until intentional removal by an overcoming force results in its removal. The magnetic disc may be a high-powered neodymium magnet. The magnetic disc may be 48 mm in diameter and 9 mm in height. The mounting means may be selected from the group consisting of a picatinny rail, a bolt, a mounting arm, or a clamp. The support bag may be attached to the magnetic disc by a metal disc. The magnetic disc may generate a plurality of magnetic lines of force which attract the metal disc of the support bag in a self-aligning process. The metal disc may be disposed on top of the support bag. The outer surface may be made of a durable textile material. The durable textile material may be nylon. The surface may be pliable allowing the bottom surface to conform to a plurality of uneven surfaces to produce a stable shooting platform. The dual stabilization device may further comprise a backing plate that may be disposed on an underside of the top surface. The dual stabilization device may further comprise a plurality of flush mount fasteners that may pass through the metal disc and the top surface and then terminate in the backing plate. The support bag may be filled with a fill material that is dense, heavy, and conforming. The folding means may be a hinge. The rifle may be selected from the group consisting of an assault style rifle, a sporting rifle, a hunting rifle, a target rifle, an air rifle, or a paint ball rifle.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
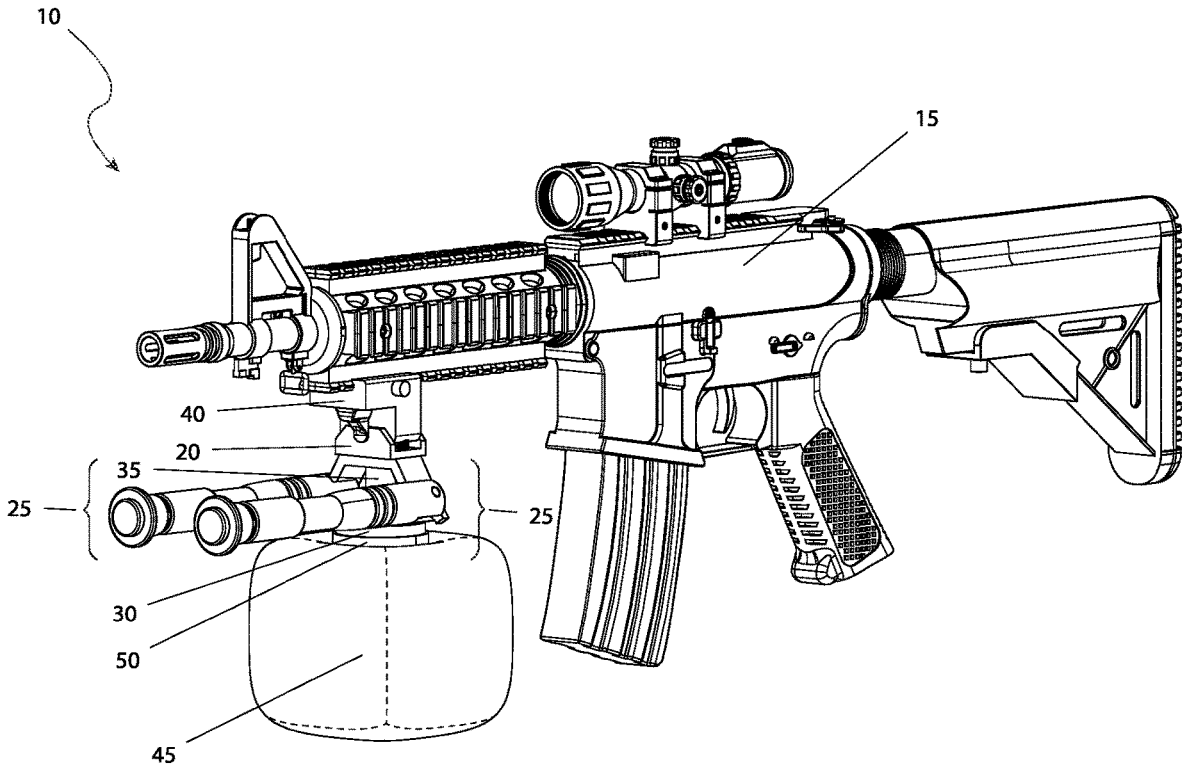
FIG. 1 is a perspective view of the dual stabilization device for a rifle, shown in a utilized state on a rifle, according to the preferred embodiment of the present invention.

10 dual stabilization device
15 rifle
20 mounting hub
25 leg
30 magnetic disc
35 pendant
40 mounting means
45 support bag
50 metal disc
55 folding means
60 magnetic lines of force
65 leg cap
70 length adjusting means
75 outer surface
80 seams
85 bottom surface
90 backing plate
95 top surface
100 flush mount fastener
105 fill material

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a perspective view of the dual stabilization device 10 for a rifle 15, shown in a utilized state on a rifle 15, according to the preferred embodiment of the present invention is disclosed. The dual stabilization device (herein also described as the "device") 10, comprises a mount for a rifle 15 that combines the functionality of a bipod mount and a bean support bag 45. The rifle 15 as depicted in FIG. 1, typically referred to as an assault style rifle, is for illustrative purposes only. Other types of rifles 15 such as sporting rifles, hunting rifles, target rifles, air rifles, paint ball rifles, and even shotguns can be used with the teachings of the present invention. As such, the use of the device 10 with any particular style of rifle 15 is not intended to be a limiting factor of the present invention.

The device 10 provides for a mounting hub 20 which holds two (2) folding and adjustable length legs 25. The legs 25 are of a conventional design that would be otherwise found on a typical bipod support system for a rifle 15. A magnetic disc 30, approximately forty-eight millimeters (48 mm) in diameter and nine millimeters (9 mm) in height, is supported by a pendant 35 at its lower point, while the upper point of the pendant 35 is connected to the underside of the mounting hub 20. The top of the mounting hub 20 is attached to the rifle 15 by means of a mounting means 40 such as a picatinny rail, a bolt, mounting arm, clamp, or the like. The use of any particular style of mounting means 40 is not intended to be a limiting factor of the present invention. A support bag 45 is attached to the magnetic disc 30 by means of a metal disc 50. Further description of the support bag 45 and the metal disc 50 will be provided herein below. Note that while FIG. 1 displays both the legs 25 and the support bag 45 in use simultaneously, actual usage in realistic conditions would typically involve only the legs 25 in a downward position as shown with the support bag 45 removed, or the support bag 45 in use as shown, with the legs 25 in a folded position. The use of the device 10 with either the legs 25 or the support bag 45 would be used to increase accuracy of aim, ease of shooting and comfort of use thus generating more accurate shots. The specific use of the device 10 with a rifle 15 is envisioned to be used during target shooting, hunting, military operations, law enforcement operations, training, troubleshooting of the rifle 15, or other similar applications where accuracy of the shot produced by the rifle 15 is of utmost importance.

Figure 2:
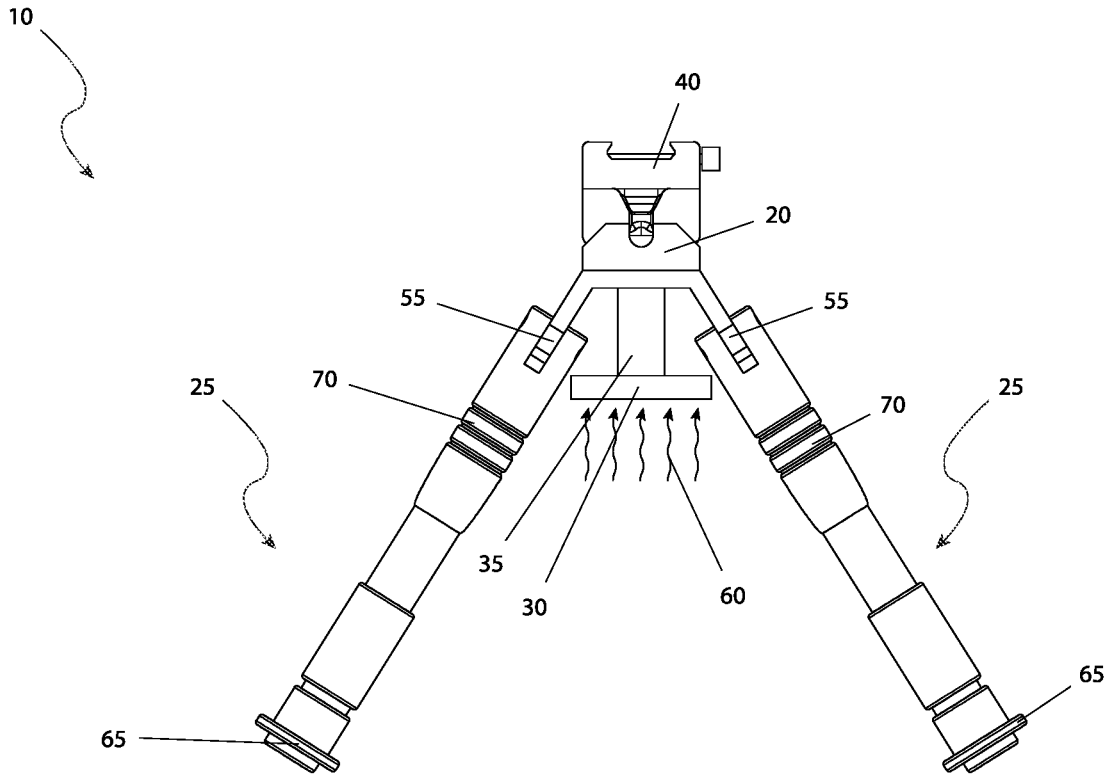
FIG. 2 is a front view of the dual stabilization device, excluding the support bag, according to the preferred embodiment of the present invention.

Referring next to FIG. 2, a front view of the device 10, excluding the support bag 45, according to the preferred embodiment of the present invention is depicted. FIG. 2 provides a clearer depiction of the mounting hub 20, aided in attachment to the rifle 15 (as shown in FIG. 1) via the mounting means 40. A folding means 55 such as a hinge allows the two (2) legs 25 to fold up (either forward and/or rearward). The magnetic disc 30 is attached to the underside of the mounting hub 20 via the pendant 35 so as to form a fixed and non-movable assembly. The magnetic disc 30 is envisioned to be of a high-powered neodymium magnet, although other types of magnets may also be utilized. The use of any specific type of magnetic disc 30 is not intended to be a limiting factor of the present invention. The magnetic disc 30 produces magnetic lines of force 60 which attract the metal disc 50 of the support bag 45 (both of which are shown in FIG. 1) in a self-aligning process. Once attracted, the magnetic disc 30 holds the support bag 45 firmly in place until intentional removal by an overcoming force (such as arm muscle strength) results in its removal. The legs 25 may be provided with accessories such as leg caps 65, length adjusting means 70, or the like.

Figure 3:
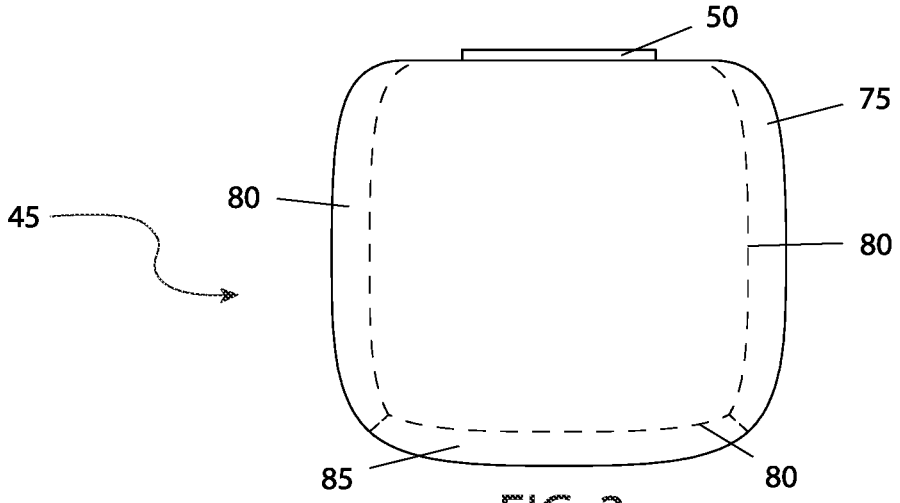
FIG. 3 is a front view of the support bag, as used with the dual stabilization device, according to the preferred embodiment of the present invention.

Referring now to FIG. 3, a front view of the support bag 45, as used with the device 10, according to the preferred embodiment of the present invention is shown. The outer surface 75 would be manufactured of a durable textile material such as nylon. It would be sewn together using manual and/or automatic sewing methods to produce seams 80 along the edges. The metal disc 50 is visible on the top of the support bag 45. Due to the pliable nature of the outer surface 75, the bottom surface 85 will conform to uneven surfaces, such as rocks, gravel, dirt, grass, and the like, as easily as even surfaces to produce a stable shooting platform.

Figure 4:
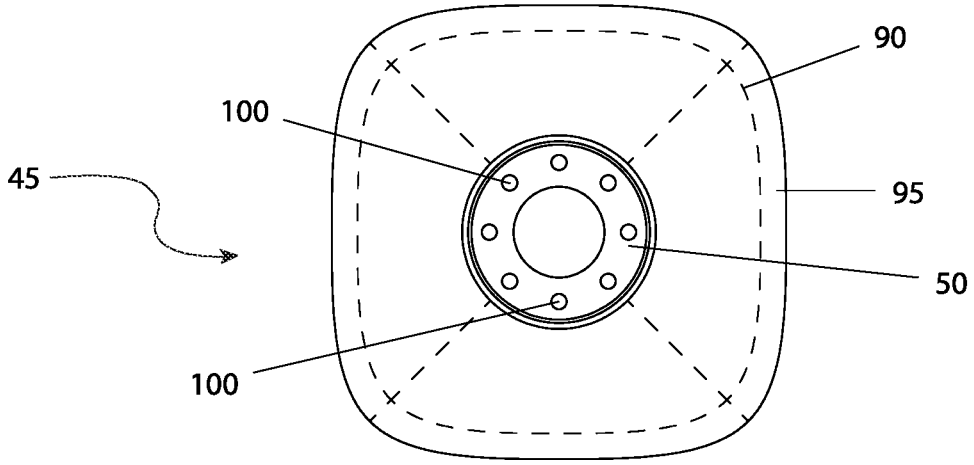
FIG. 4 is a top view of the support bag, as used with the dual stabilization device, according to the preferred embodiment of the present invention.

Referring next to FIG. 4, a top view of the support bag 45, as used with the device 10, according to the preferred embodiment of the present invention is disclosed. A backing plate 90 (herein depicted by dashed lines due to its hidden natures) is positioned on the underside of the top surface 95. A set of flush mount fasteners 100 then pass through the metal disc 50, the top surface 95 and then terminate in the backing plate 90. The flush mount fasteners 100 may be sheet metal screws, machine screws and nuts, rivets, or the like. The use of any particular style of flush mount fasteners 100 is not intended to be a limiting factor of the present invention.

Figure 5:
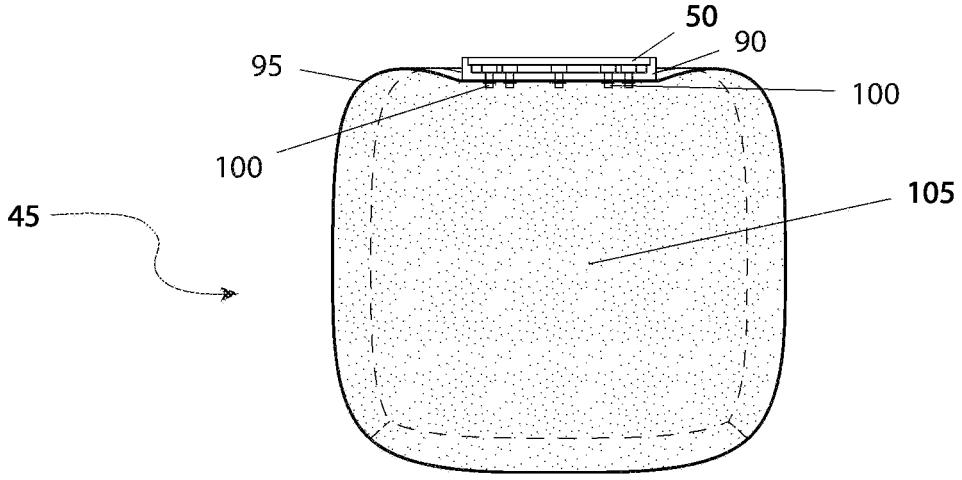
FIG. 5 is a sectional view of the support bag, as used with the dual stabilization device, as seen along a Line I-I, as shown in FIG. 4, according to the preferred embodiment of the present invention.

Referring to FIG. 5, a sectional view of the support bag 45, as used with the device 10, as seen along a Line I-I, as shown in FIG. 4, according to the preferred embodiment of the present invention is depicted. This view discloses the "sandwich" configuration formed by the metal disc 50, the top surface 95 of the support bag 45, and the backing plate 90. Said components are then fastened together by the flush mount fasteners 100. The interior of the support bag 45 is filled with a fill material 105 that is dense, heavy, and conforming such as sand, plastic pellets, rice, or similar material. The use of any particular fill material 105 is not intended to be a limiting factor of the present invention.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as firearm supply shops, mail order and internet supply houses and the like. Special attention would be paid to specific types of mounting means 40 as well as configuration of the legs 25 and support bag 45.

After procurement and prior to utilization, the device 10 would be prepared in the following manner: the mounting means 40 is attached to the rifle 15 using readily available means such as clamps, bolts, picatinny rails or the like. It is noted that the legs 25 always remain attached to the mounting hub 20, although the support bag 45 may or may not be attached to the magnetic disc 30. At this point in time, the device 10 is ready for use.

During utilization of the device 10, the following procedure would be initiated: the device 10 is utilized when increased accuracy in aiming of the rifle 15 is required. Should level and firm surfaces such as pavement or flooring be available, the user of the rifle 15 may wish to utilize the legs 25 by folding them down into position via the folding means 55. Should uneven surfaces such as earth, gravel, or the like, or when shooting when minute changes in aim are required, the user would fold the legs 25 along the folding means 55 and attach the support bag 45 via connection between the magnetic disc 30 and the metal disc 50. Aiming and shooting with either the use of the legs 25 or the support bag 45 would continue in a conventional manner.

After use of the device 10, the support bag 45 would customarily be removed via uncoupling of the metal disc 50 from the magnetic disc 30, thus allowing removal of the support bag 45 due to weight considerations. The balance of the device 10 including the mounting hub 20, the mounting means 40 and the legs 25 would likely remain attached to the rifle 15, although removal is possible as well.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A dual stabilization device, comprising:

a rifle utilized where accuracy of a shot produced by the rifle is important;

a mounting hub having a pair of legs, the pair of legs are folding and adjustable length legs, the pair of legs are for a bipod support system to increase accuracy of aim, ease of shooting and comfort of use thus generating one or more accurate shots;

a magnetic disc supported by a pendant at a first point, while a second point of the pendant is connected to an underside of the mounting hub, the first point of the pendant is lower than the second point of the pendant;

a mounting means attached to a top of the mounting hub is attached to the rifle to the mounting hub;

a support bag attached to the magnetic disc, the support bag includes an outer surface, a plurality of seams, and a bottom surface; and a folding means folding up the pair of legs.

2. The dual stabilization device, according to claim 1, wherein the support bag is used to increase accuracy of aim, ease of shooting and comfort of use thus generating the one or more accurate shots.

3. The dual stabilization device, according to claim 1, wherein each of the pair of legs include a leg cap.

4. The dual stabilization device, according to claim 1, wherein each of the pair of legs include a length adjusting means.

5. The dual stabilization device, according to claim 1, wherein the magnetic disc is attached to an underside of the mounting hub via the pendant to form a fixed and non-movable assembly.

6. The dual stabilization device, according to claim 1, wherein the magnetic disc holds the support bag in place once attracted, until intentional removal by an overcoming force results in its removal.

7. The dual stabilization device, according to claim 1, wherein the magnetic disc is a high-powered neodymium magnet.

8. The dual stabilization device, according to claim 1, wherein the magnetic disc is 48 mm in diameter and 9 mm in height.

9. The dual stabilization device, according to claim 1, wherein the mounting means is selected from the group consisting of a picatinny rail, a bolt, a mounting arm, or a clamp.

10. The dual stabilization device, according to claim 1, wherein the support bag is attached to the magnetic disc by a metal disc.

11. The dual stabilization device, according to claim 10, wherein the magnetic disc generates a plurality of magnetic lines of force which attract the metal disc of the support bag in a self-aligning process.

12. The dual stabilization device, according to claim 10, wherein the metal disc is disposed on top of the support bag.

13. The dual stabilization device, according to claim 1, wherein the outer surface is made of a durable textile material.

14. The dual stabilization device, according to claim 13, wherein the durable textile material is nylon.

15. The dual stabilization device, according to claim 1, wherein the outer surface is pliable allowing the bottom surface to conform to a plurality of uneven surfaces to produce a stable shooting platform.

16. The dual stabilization device, according to claim 1, further comprising a backing plate is disposed on an underside of the top surface.

17. The dual stabilization device, according to claim 16, further comprising a plurality of flush mount fasteners that pass through the metal disc and the top surface and then terminate in the backing plate.

18. The dual stabilization device, according to claim 1, wherein the support bag is filled with a fill material that is dense, heavy, and conforming.

19. The dual stabilization device, according to claim 1, wherein the folding means is a hinge.

20. The dual stabilization device, according to claim 1, wherein the rifle is selected from the group consisting of an assault style rifle, a sporting rifle, a hunting rifle, a target rifle, an air rifle, or a paint ball rifle.

* * * * *